United States Patent [19]

Cowen, Jr. et al.

[11] 4,258,964

[45] Mar. 31, 1981

[54] MODULAR CABINET WITH MIRROR

[75] Inventors: Theodore A. Cowen, Jr.; Thomas F. McCartan, both of Belvidere, Ill.

[73] Assignee: Belvedere Company, Inc., Belvidere, Ill.

[21] Appl. No.: 58,827

[22] Filed: Jul. 19, 1979

[51] Int. Cl.[3] ..... A45D 44/02

[52] U.S. Cl. ..... 312/224; 312/194; 312/209; 312/239

[58] Field of Search ..... 312/224–226, 312/209, 239, 195, 194

[56] References Cited

U.S. PATENT DOCUMENTS

| | | | |
|---|---|---|---|
| 1,449,548 | 3/1923 | Raun-Linde | 312/225 |
| 3,138,415 | 6/1964 | McMaster | 312/209 |
| 3,295,206 | 1/1967 | Sharp et al. | 312/209 |
| 3,922,788 | 12/1975 | Rota | 312/209 |

*Primary Examiner*—Casmir A. Nunberg
*Attorney, Agent, or Firm*—Morsbach & Pillote

[57] ABSTRACT

A modular cabinet with mirror for use in beauty parlors having a generally chevron shaped counter top providing first and second counter top portions interconnected at one and end and extending at an obtuse angle to each other with a mirror mounted on one counter top portion and extending upwardly adjacent its rear edge at an angle of 120° to the rear edge of the other counter top portion. Storage drawers are mounted below the other counter top portion for movement along a path paralleling the rear edge of the other countertop portion between a closed position and an end-out position in which part of the drawers extend outwardly of the end of the counter top.

21 Claims, 9 Drawing Figures

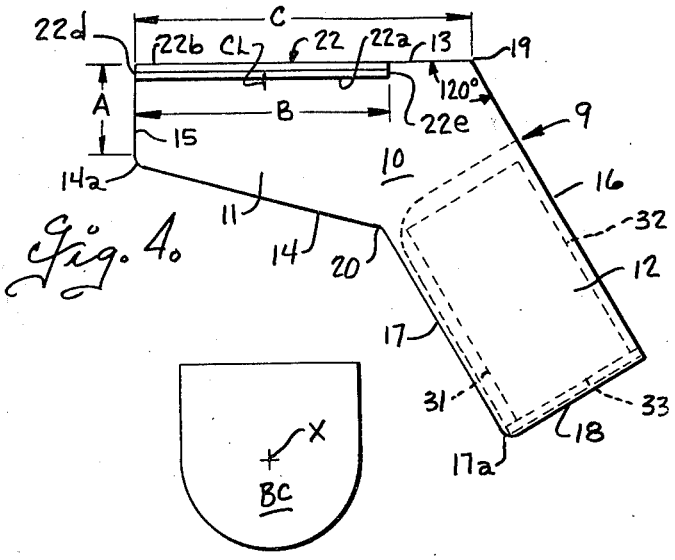
Fig. 4.
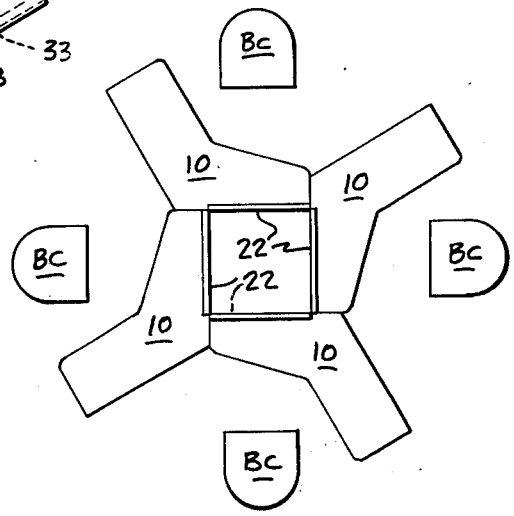
Fig. 9.
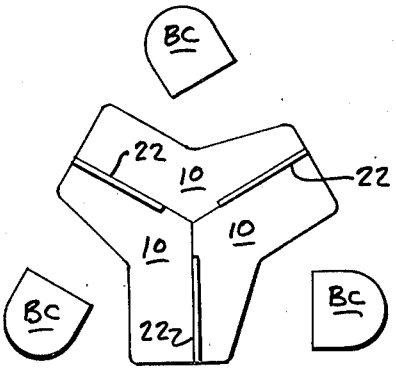
Fig. 8.
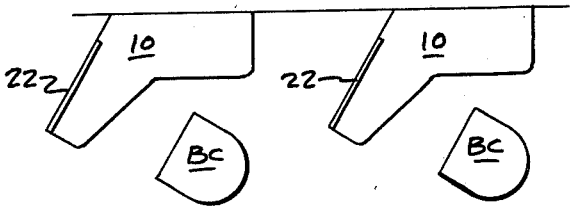
Fig. 5.
Fig. 6.
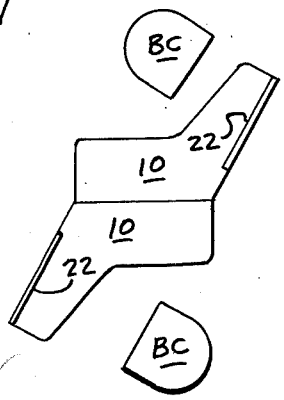
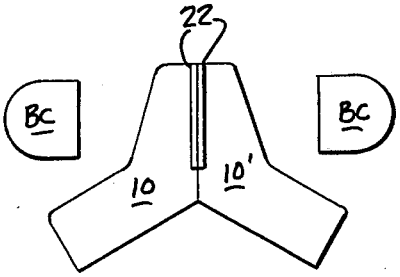
Fig. 7.

MODULAR CABINET WITH MIRROR

SUMMARY OF THE INVENTION:

It is an object of the present invention to provide a modular cabinet with mirror which can be used adjacent the beautician's chair in a beauty parlor to provide a convenient work area for the beautician, and which modular cabinet is so constructed and arranged that it can be used either singly or combined in different arrays with other similar units to provide a plurality of beautician work areas.

Accordingly, the present invention provides a modular cabinet having a generally chevron shape counter top providing first and second counter top portions interconnected at one end and extending at an obtuse angle to each other with a mirror mounted on one counter top portion and extending upwardly from adjacent its rear edge at an angle of 120° to the rear edge of the other counter top portion.

The invention further provides storage drawers below the other counter top portion and mounted for movement along a path paralleling the rear edge of the other counter top portion between a closed position and an end-out position in which part of the drawers extend outwardly of the end of the counter top.

These, together with other objects, features and advantages of the present invention will be more readily understood by reference to the following detailed description, when taken in connection with the accompanying drawings wherein:

FIG. 4 is a top plan view of the modular cabinet with mirror in position adjacent a beautician's chair;

FIG. 5 is a plan view illustrating several modular cabinets arranged in a row along a wall;

FIG. 6 is a plan view illustrating two like modular cabinet units in a back-to-back arrangement;

FIG. 7 is a plan view showing two reversely symmetrical modular cabinet units in a back-to-back arrangement;

FIG. 8 is a plan view illustrating three modular cabinet units arranged in a triangular array; and FIG. 9 is a plan view illustrating four modular cabinet units arranged in a rectangular array.

Figure 1:
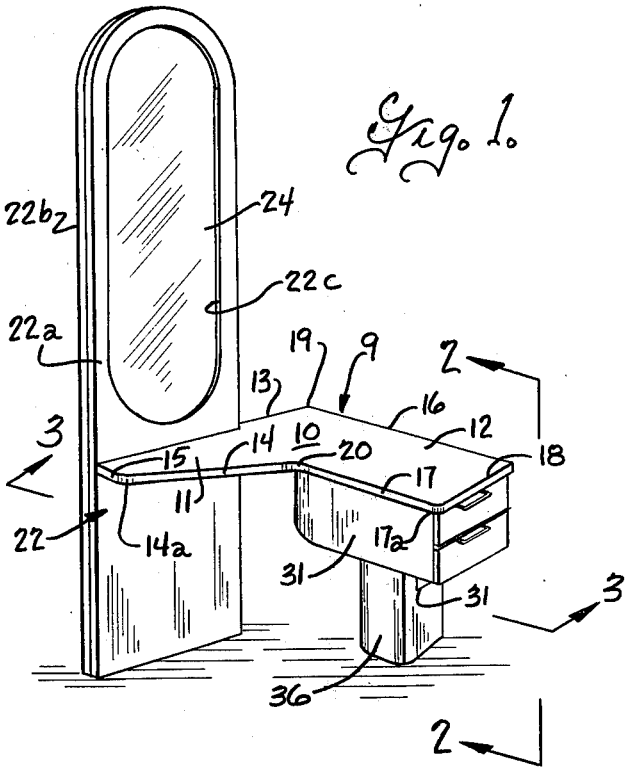
FIG. 1 is a perspective view of a modular cabinet with mirror embodying the present invention.

Referring now more specifically to FIGS. 1—4 of the drawings, each modular cabinet 9 includes a generally chevron shaped counter top 10 which defines first and second counter top portions 11 and 12 that are interconnected at one end and extend at an obtuse angle to each other. The first counter top portion 11 has a rear edge 13, a front edge 14, and an end edge 15 that extends between the rear and front edges 13 and 14 at one end of the counter top. The second counter top portion 12 has a rear edge 16, a front edge 17 and an end edge 18 that extends between the rear and front edges 16 and 17, at the other end of the counter top 10. The rear edges 13 and 16 intersect at a rear exterior corner 19, and define an included angle of 120°. In the preferred embodiment, the rear edges 13 and 16 of the counter top portions 11 and 12, are of the same length, to facilitate interfitting of similar units in different arrays. The end edges 15 and 18 extend perpendicular to the respective rear edge 13 and 16. The front edges 14 and 17 intersect at a forward interior corner 20. The front edge 17 of the counter top portion 12 preferably extends parallel to the rear edge 16, and the front edge 14 of the counter top portion 11 preferably converges relative to its rear edge 13, in a direction away from the front corner 20. The front edge 14 joins the end edge 15 at exterior corner **14*a* and preferably, corner 14*a* is rounded as best shown in FIG. 4 to avoid a sharp exterior corner. Similarly, the front edge 17 joins the side edge 18 at a corner 17*a* and the corner 22 is also preferably rounded as shown in FIG. 4. The chevron shape counter top is adapted to be positioned so that one counter top portion 11 is located adjacent the front of a beautician's chair indicated at BC in FIGS. 4—8, while the other counter top portion 12 is located adjacent one side of the beautician's chair to provide a convenient work surface for the beautician. The beautician's chair BC is preferably of the swivel type which can be turned relative to its base about an upright axis designated X in FIG. 4, and the cabinet is positioned relative to the chair so as to provide clearance for the chair and occupant during turning of the chair and a work area for the beautician between the chair and the counter top portion 12**.

The cabinet also supports a mirror at a position for use by the patron in the beauty chair. For this purpose, an upright panel 22 is mounted on the counter top portion 11 adjacent and parallel to its rear edge. The panel has a lower portion that extends downwardly from the counter top portion 11 to provide a support leg for the counter top and an upper portion that extends above the counter top 11 to support a mirror 24. In the embodiment shown the panel 22 is formed from separate front and rear panel members **22*a* and 22*b* that are joined together to form the panel 22. The front panel member is formed with an opening 22*c* for the mirror and the mirror 24 is mounted between the front and rear panels. Thus, the front panel is arranged to form a frame for the mirror. In the embodiment shown, the mirror has a generally oval shape, it being understood that other mirror shapes such as rectangular could be used and that other arrangements could be provided for mounting the mirror on the panel 22** and framing the mirror.

The mirror is preferably dimensioned and positioned so that a patron in the beauty chair BC will be generally horizontally centered with respect to the mirror, when the beauty chair is positioned with its front generally parallel to the plane of the mirror, as shown in FIG. 4. Accordingly, it is preferable to form the mirror and mounting panel 22 with a width substantially less than the length of the rear edge 13 of the counter top portion 11 and to position the mirror mounting panel 22 with one upright edge **22*d* adjacent the end edge 15 of the counter top portion 11, and with the other upright edge 22*e* spaced a substantial distance from the rear corner 19. In order to facilitate arrangement of four similar units in a generally rectangular pattern as shown in FIG. 8, the width of the rear mounting panel designated B in FIG. 4 is made less than the length of the rear edge 13, designated C in FIG. 4, by an amount approximately equal to the straight or effective length of the end edge 15, designated A in FIG. 4. For example, the length of the rear edge 13 of the counter top portion 11 designated by the letter C in FIG. 4, can be 32 inches; the width of the panel 22 designated B in FIG. 4 $23\frac{7}{8}$ inches; and the effective length of the end edge 15** designated A in FIG. 4, $8\frac{1}{8}$ inches. When the upright panel and counter top are proportioned in this manner, four similar modular cabinets can be arranged in a generally rectangular pattern as shown in FIG. 9 with the upright panels 22 in edge-to-edge relation to form a square, and with the end face 15 of one unit disposed contiguous to that portion of the rear edge 13 of an adjacent unit that extends beyond the panel 22. The cabinets can also be arranged in a triangular array as shown in FIG. 8 or in paired arrays as shown in FIGS. 6 and 7. In the preferred embodiment, the counter top portion 11 is recessed along its rear edge to receive the upright panel 22, with the back side of the panel 22 generally coplanar with the portion of the rear edge that extends beyond the panel. Although the mirror mounting panel and mirror are horizontally offset toward one end of the rear edge 13 of the counter top portion 11, it will be seen from FIG. 4 that the mirror mounting panel and hence the mirror are positioned such that a plane through the vertical center line CL of the mirror and perpendicular to the mirror, will approximately bisect the forward edge 14 of the counter top portion 11.

Figure 2:
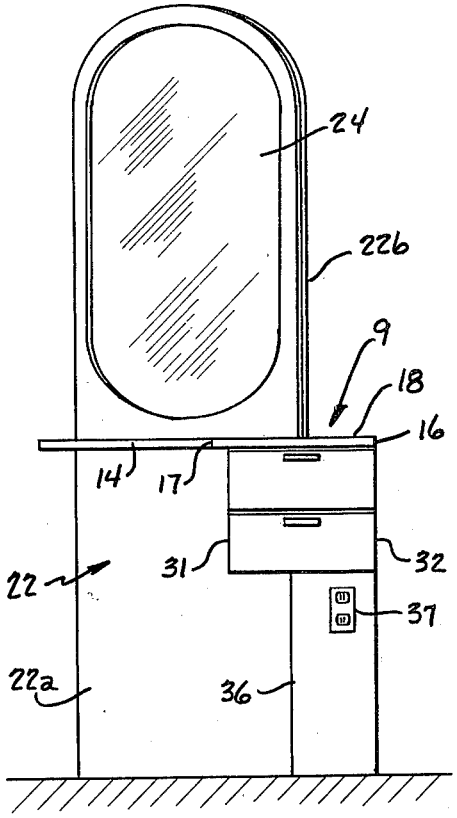
FIG. 2 is an end elevational view taken on the plane 2—2 of FIG. 1.
Figure 3:
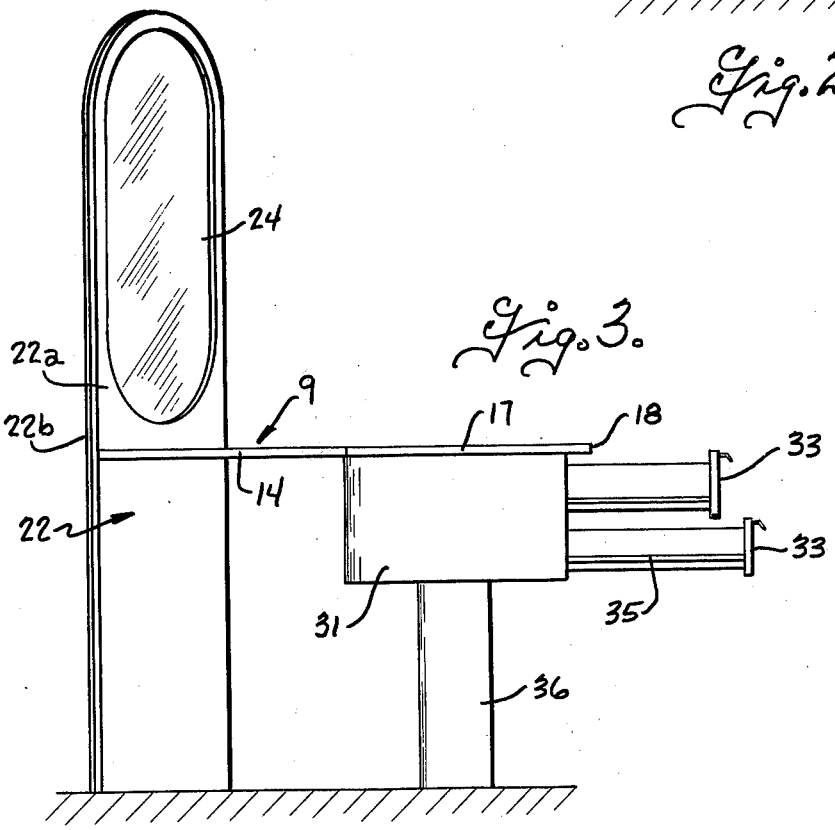
FIG. 3 is a side elevational view taken on the plane 3—3 of FIG. 1 and with the drawers in an end-out position.

The counter top portion 12 extends along one side of the beautician's chair to provide a convenient work surface. Storage drawers for beautician's accessories and supplies are advantageously provided below the counter top portion 12. For this purpose, a housing is provided below the counter top portion 12 and includes a front wall 31 that extends downwardly from the counter top 12 adjacent and generally parallel to the front edge 17 and a rear wall 32 that extends downwardly adjacent and generally parallel to the rear edge of the counter top portion 12. One or more drawers such as indicated at 33 are mounted as by conventional extensible drawer slides 35 on the front and rear walls 31 and 32 for movement between a closed position as shown in FIGS. 1 and 2 and an end-out position as shown in FIG. 3 in which a part of the drawer extends outwardly from the end edge 18 of the counter top portion 12. The housing including the front and rear walls 32 is supported on a pedestal 36, conveniently located intermediate the ends of the housing and preferably offset toward the rear wall as best shown in FIG. 2. This provides clearance for the patron in the beautician's chair BC when the beautician's chair is turned about its axis. An electrical power outlet receptacle 37 can conveniently be provided in the pedestal 36 at the side adjacent the end edge 18 of the counter top, to enable operation of beautician's electrical accessories.

In the embodiment illustrated in FIGS. 1–4, the modular cabinets are of so-called right hand type in which the counter top portion 12 having drawers 33 is located at the right of the beautician's chair BC when the mirror is positioned in front of the beautician's chair. It is contemplated that left hand units can be provided in which the counter top portion 12 is disposed at the left of the beautician's chair when the mirror is positioned in front of the chair, for example as shown at 10′ in FIG. 7.

From the foregoing it will be seen that the modular cabinet units with mirrors can be used singly; for example, at spaced locations along a wall. The single modular cabinet units can be arranged with either the rear edge 16 of the second counter top portion 12 against the wall, as shown in FIG. 5, or they can be arranged with the upright panel 22 against the wall. The modular cabinet units can also be combined with other similar units in a wide variety of arrays to provide multiple beautician work areas. Some different multiple unit arrangements are illustrated in FIGS. 7, 8 and 9. In FIG. 6, a pair of right hand cabinet units are arranged with the rear edges 16 in back-to-back relation, it being apparent that they could also be arranged with the panels 22 in back-to-back relation. In FIG. 7, similar left and right modular cabinet units are shown arranged in pairs with mirror mounted panels 22 in back-to-back relation, it being apparent that the left and right modular cabinet units could also be in pairs with the counter top portions 12 in back-to-back relation. In FIG. 8, three similar right hand units are mounted in triangular array with the counter top portion 11 of each unit in back-to-back relation to the counter top portion 12 of an adjacent unit. As will be seen, forming the rear edges 13 and 16 of equal length and recessing of the upright panels 22, facilitates arranging the modular cabinet units in a triangular configuration as shown in FIG. 8. FIG. 9 illustrates four similar right hand units arranged in a rectangular pattern, with the upright panels 22 of the units forming a square enclosure. With this arrangement it is advantageous to have the length designated C of the rear edge 13 of the counter top portion 11 made equal to the sum of the width B of the right panel 22 and the effective when designated A of the end edge 15 of the counter top portion 11.

The mirror 24 is disposed in a plane at an angle of substantially 120° to the rear edge 16 of the counter top portion 12 and the width and position of the mirror is made such that the mirror is substantially centered with respect to the occupant in the beautician's chair when the beautician's chair is positioned to have the occupant face the mirror. Further, the drawers 33 are movable to an end-out position beyond the end of the counter top 12, where the contents of the drawer are accessible to the beautician but the drawers do not themselves interfere with the movement of the beautician in the area between the chair and the counter top portion 12 or turning of the chair and its occupant.

The embodiments of the invention in which an exclusive property or privilege is claimed are defined as follows:

1. A modular beautician's cabinet for use with a beautician's chair in a beauty parlor, the cabinet comprising, a generally horizontal chevron shaped counter top defining a first counter top portion located in front of the chair and second counter top portion interconnected at one end to the first counter top portion and extending at an obtuse angle to the first counter top portion and in diverging relation to one side of the chair when the chair front faces the first counter top portion, the first counter top portion having a first rear edge and a first front edge and a first end edge at a first end of the counter top, the second counter top portion having a second rear edge and a second front edge and a second end edge at a second end of the counter top, the second rear edge extending at an included angle of 120° relative to the first rear edge, a first support means attached to the first counter top portion and a second support means attached to the second counter top portion for supporting the counter top on a floor, a mirror, mirror mounting means mounting the mirror on the cabinet to extend above the first counter top portion in a plane adjacent to and paralleling said first rear edge and at an angle of 120° to said second rear edge, and storage means below said second counter top portion for beautician accessories and supplies.

2. A modular cabinet according to claim 1 wherein the first and second rear edges intersect at a rear corner, said mirror has a width substantially less than the length of said first rear edge and the mirror has one upright edge adjacent said first end edge and a second upright edge spaced a substantial distance from said rear corner.

3. A modular cabinet according to claim 1 wherein first and second rear edges intersect at a rear corner and said first and second front edges intersect at a front corner, said mirror has a width substantially less than the length of said first rear edge and the mirror is positioned along said first rear edge such that a plane perpendicular to the mirror through its vertical center line intersects said first front edge approximately medially between said front corner and said first end edge.

4. A modular cabinet according to claim 1 including an upright panel attached to said first counter top portion along said first rear edge, said upright panel having a lower portion extending downwardly from the first counter top portion and providing said first support means and an upper portion extending above said first counter top portions and providing said mirror mounting means.

5. A modular cabinet adapted to be positioned adjacent a beautician's chair in a beauty parlor, the cabinet comprising, a generally horizontal chevron shaped counter top defining first and second counter top portions interconnected at one end and extending at an obtuse angle to each other, the first counter top portion having a first rear edge and a first front edge and a first end edge at a first end of the counter top, the second counter top portion having a second rear edge and a second front edge and a second end edge at a second end of the counter top, a first support means attached to the first counter top portion and a second support means attached to the second counter top portion for supporting the counter top on a floor, a mirror, and mirror mounting means mounting the mirror on the cabinet to extend above the first counter top portion in a plane adjacent to and paralleling said first rear edge and at an angle of 120° to said second rear edge, an upright panel attached to said first counter top portion along said first rear edge, said upright panel having a lower portion extending downwardly from the first counter top portion and providing said first support means and an upper portion extending above said first counter top portions and providing said mirror mounting means, said first and second rear edges intersect at a rear corner, said upright panel has a width substantially less than the length of said first rear edge and the upright panel has one upright edge adjacent said first end edge and a second upright edge spaced a substantial distance from the rear corner.

6. A modular cabinet adapted to be positioned adjacent a beautician's chair in a beauty parlor, the cabinet comprising, a generally horizontal chevron shaped counter top defining first and second counter top portions interconnected at one end and extending at an obtuse angle to each other, the first counter top portion having a first rear edge and a first front edge and a first end edge at a first end of the counter top, the second counter top portion having a second rear edge and a second front edge and a second end edge at a second end of the counter top, a first support means attached to the first counter top portion and a second support means attached to the second counter top portion for supporting the counter top on a floor, a mirror, and mirror mounting means mounting the mirror on the cabinet to extend above the first counter top portion in a plane adjacent to and paralleling said first rear edge and at an angle of 120° to said second rear edge, an upright panel attached to said first counter top portion along said first rear edge, said upright panel having a lower portion extending downwardly from the first counter top portion and providing said first support means and an upper portion extending above said first counter top portions and providing said mirror mounting means, the first and second rear edges intersect at a rear corner, said upright panel has a width substantially less than the length of said first rear edge and the upright panel has one upright edge adjacent said first end edge and a second upright edge spaced from said rear corner a distance approximately equal to the length of said first end edge.

7. A modular cabinet, according to claim 5 wherein the first counter top portion has a portion of its first rear edge recessed to receive said upright panel with the rear side of the upright panel in substantially the same vertical plane as the portion of the first rear edge that extends between the upright panel and said rear corner.

8. A modular cabinet according to claim 1 wherein said second front edge extends generally parallel to said second rear edge, and said first front edge converges relative to said first rear edge in a direction toward said first end edge.

9. A modular cabinet according to claim 1 wherein said first and second rear edges intersect at a rear corner, the length of said first and second rear edges being substantially the same.

10. A modular cabinet adapted to be positioned adjacent a beautician's chair in a beauty parlor, the cabinet comprising, a generally horizontal chevron shaped counter top defining first and second counter top portions interconnected at one end and extending at an obtuse angle to each other, the first counter top portion having a first rear edge and a first front edge and a first end edge at a first end of the counter top, the second counter top portion having a second rear edge and a second front edge and a second end edge at a second end of the counter top, a first support means attached to the first counter top portion and a second support means attached to the second counter top portion for supporting the counter top on a floor, a mirror, and mirror mounting means mounting the mirror on the cabinet to extend above the first counter top portion in a plane adjacent to and paralleling said first rear edge and at an angle of 120° to said second rear edge, said first and second rear edges intersect at a rear corner, the length of said first and second rear edges being substantially the same, the second front edge extends generally parallel to the second rear edges, the first front edge converges relative to said first rear edge in a direction toward said first end edge, the second end edge extends perpendicular to the second rear edge, the first end edge extends perpendicular to the first rear edge and is substantially shorter than said second end edge.

11. A modular cabinet according to claim 1 including drawer means mounted below said second counter top portion for movement along a path paralleling said second rear edge from a closed position below said second counter top portion to an end-out position in which a part of the drawer means extends outwardly of said second end edge.

12. A modular cabinet adapted to be positioned adjacent a beautician's chair in a beauty parlor, the cabinet comprising, a generally horizontal chevron shaped counter top defining first and second counter top portions interconnected at one end and extending at an obtuse angle to each other, the first counter top portion having a first rear edge and a first front edge and a first end edge at a first end of the counter top, the second counter top portion having a second rear edge and a second front edge and a second end edge at a second end of the counter top, a first support means attached to the first counter top portion and a second support means attached to the second counter top portion for supporting the counter top on a floor, a mirror, and mirror mounting means mounting the mirror on the cabinet to extend above the first counter top portion in a plane adjacent to and paralleling said first rear edge and at an angle of 120° to said second rear edge, a housing below said second counter top portion having a front wall extending downwardly adjacent said second front edge and a rear wall extending downwardly adjacent said second rear edge, drawer means mounted below said second counter top portion between said front and rear walls for movement along a path paralleling said second rear edge from a closed position below said second counter top portion to an end-out position in which part of the drawer means extends outwardly of said second end edge.

13. A modular cabinet according to claim 12 wherein said second support means includes a pedestal attached to said housing and extending downwardly therefrom.

14. A modular beautician's cabinet for use with a beautician's chair in a beauty parlor, the cabinet comprising, a generally chevron shaped counter top defining a first counter top portion located in front of the chair and second counter top portion interconnected at one end to the first counter top portion and extending at an obtuse angle to the first counter top portion and in diverging relation to one side of the chair when the chair front faces the first counter top portion, the first counter top portion having a first rear edge and a first front edge and a first end edge at a first end of the counter top, the second counter top portion having a second rear edge and a second front edge and a second end edge at a second end of the counter top, an upright panel attached to said first counter top portion along said first rear edge, said upright panel having a lower panel portion extending downwardly from the first counter top portion and providing a first support leg and an upper panel portion extending above the first counter top portion to provide a mirror support, a mirror mounted on said upper panel portion, said second rear edge extending at an angle of 120° to the plane of said mirror, and a second support means for supporting the second counter top portion.

15. A modular cabinet according to claim 14 wherein said first and second rear edges intersect at a rear corner and define an included angle of 120°, said upright panel having a width substantially less than said first rear edge, said upright panel having one upright edge adjacent said first end edge and a second upright edge spaced from said rear corner a distance approximately equal to the length of said first end edge.

16. A modular cabinet according to claim 14 wherein said first and second rear edges intersect at a rear corner and define an included angle of 120°; said upright panel having a width substantially less than the length of said first rear edge, said upright panel having one upright edge adjacent said first end edge and a second upright edge spaced a substantial distance from said corner, said first counter top portion having a portion of its first rear edge recessed to receive said upright panel with the rear side of the upright panel in substantially the same place as the portion of the first rear edge that extends between the upright panel and said rear corner.

17. A modular cabinet according to claim 16 including a housing below said second counter top portion having a front wall extending downwardly adjacent said second front edge and a rear wall extending downwardly adjacent said second rear edge, drawer means mounted below said second counter top portion between said front and rear walls for movement along a path paralleling said second rear edge from a closed position below said second counter top portion to an end-out position in which part of the drawer means extends outwardly of said second end edge.

18. A modular cabinet comprising, a generally chevron shaped counter top defining first and second counter top portions interconnected at one end and extending at an obtuse angle to each other, the first counter top portion having a first rear edge and a first front edges and a first end edge at a first end of the counter top, the second counter top portion having a second rear edge and a second front edge and a second end edge at a second end of the counter top, an upright panel attached to said first counter top portion along said first rear edge, said upright panel having a lower panel portion extending downwardly from the first counter top portion and providing a first support leg and an upper panel portion extending above the first counter top portion to provide a mirror support, a mirror mounted on said upper panel portion, a second support means for supporting the second counter top portion, a housing below said second counter top portion having a front wall extending downwardly adjacent said second front edge and a rear wall extending downwardly adjacent said second rear edge, drawer means mounted below said second counter top portion between said front and rear walls for movement along a path paralleling said second rear edge from a closed position below said second counter top portion to an end-out position in which part of the drawer means extends outwardly of said second end edge.

19. A modular cabinet comprising, a generally chevron shaped counter top defining first and second counter top portions interconnected at one end and extending at an obtuse angle to each other, the first counter top portion having a first rear edge and a first front edge and a first end edge at a first end of the counter top, the second counter top portion having a second rear edge and a second front edge and a second end edge at a second end of the counter top, an upright panel attached to said first counter top portion along said first rear edge, said upright panel having a lower panel portion extending downwardly from the first counter top portion and providing a first support leg and an upper panel portion extending above the first counter top portion to provide a mirror support, a mirror mounted on said upper panel portion, a second support means for supporting the second counter top portion, said upright panel including front and rear panel members, said front panel member having a mirror opening therein, and said mirror being mounted between said panel members in registry with said mirror opening.

20. A modular beautician's cabinet for use with a beautician's chair in a beauty parlor, the cabinet having mirror mounting section and a cabinet section interconnected at one end and extending at an obtuse angle to each other respectively adjacent the front and one side of the beautician's chair, the mirror mounting section including a mirror and an upright floor supported mirror mounting means for supporting the mirror in a generally upright plane in front of the beautician's chair, the cabinet section including a counter top joined at one end to the mirror mounting section and having a rear edge and a front edge and an end edge at the end remote from the mirror mounting section, the rear edge extending at an included angle of 120° to the plane of the mirror and intersecting that plane outwardly of the mirror, the front edge of the counter top diverging relative to the side of the chair when the chair front faces the mirror, a housing below the counter top having a front wall extending downwardly adjacent said front edge and a rear wall extending downwardly adjacent said rear edge, drawer means mounted below said counter top between said front and rear walls for movement along a path generally paralleling said rear edge of said countertop from a closed position below said counter top to an end-out position in which at least part of the drawer means extends outwardly beyond said end edge of the countertop for access to the contents of the drawer.

21. A modular beautician's cabinet according to claim 20 wherein said mirror mounting means includes an upright panel extending from the floor to a level above the counter top.

* * * * *